US007023343B2

(12) United States Patent
Jørgensen

(10) Patent No.: US 7,023,343 B2
(45) Date of Patent: Apr. 4, 2006

(54) METHOD OF PRODUCING A DEACTIVATABLE RESONANCE TAG FOR USE IN AN ELECTRONIC ARTICLE SURVEILLANCE SYSTEM AND A RESONANCE TAG SO PRODUCED

(75) Inventor: Poul Richter Jørgensen, Svendborg (DK)

(73) Assignee: Kobe Properties, Ltd., Isle of Man (GB)

( * ) Notice: Subject to any disclaimer, the term of this patent is extended or adjusted under 35 U.S.C. 154(b) by 89 days.

(21) Appl. No.: 10/472,088

(22) PCT Filed: Mar. 19, 2001

(86) PCT No.: PCT/IB01/00412

§ 371 (c)(1),
(2), (4) Date: Oct. 30, 2003

(87) PCT Pub. No.: WO02/075686

PCT Pub. Date: Sep. 26, 2002

(65) Prior Publication Data

US 2004/0080417 A1 Apr. 29, 2004

(51) Int. Cl.
*G08B 13/14* (2006.01)

(52) U.S. Cl. ..... 340/572.3; 340/572.1

(58) Field of Classification Search ..... 340/572.3, 340/572.1, 572.6
See application file for complete search history.

(56) References Cited

U.S. PATENT DOCUMENTS

| | | | | |
|---|---|---|---|---|
| 5,187,466 | A | 2/1993 | Pichl | |
| 5,510,770 | A * | 4/1996 | Rhoads | 340/572.3 |
| 5,608,379 | A * | 3/1997 | Narlow et al. | 340/572.6 |
| 5,608,380 | A * | 3/1997 | Hogen Esch | 340/572.3 |
| 5,841,350 | A * | 11/1998 | Appalucci et al. | 340/572.3 |
| 6,400,271 | B1 * | 6/2002 | Davies et al. | 340/572.1 |

FOREIGN PATENT DOCUMENTS

| | | |
|---|---|---|
| EP | 0 750 285 A2 | 12/1996 |
| EP | 0 750 285 A3 | 2/1997 |
| WO | WO 92/09978 A1 | 6/1992 |

* cited by examiner

*Primary Examiner*—Daniel Wu
*Assistant Examiner*—Samuel J Walk
(74) *Attorney, Agent, or Firm*—Breiner & Breiner, L.L.C.

(57) ABSTRACT

A method for producing a deactivatable tag is described including first short circuiting two opposite conductive layers at a predetermined place by using a heated tool applied on one of the layers, thereby permanently deforming such layer to produce a short, checking the quality of the short, and if the quality of the short is satisfactory, then connecting the two conductive layers with a crimp to obtain the desired frequency and finally removing the short by electrically or mechanically removing the short circuit to thereby bring the tag in the desired form ready for use and deactivation.

8 Claims, 1 Drawing Sheet

Figure 1:
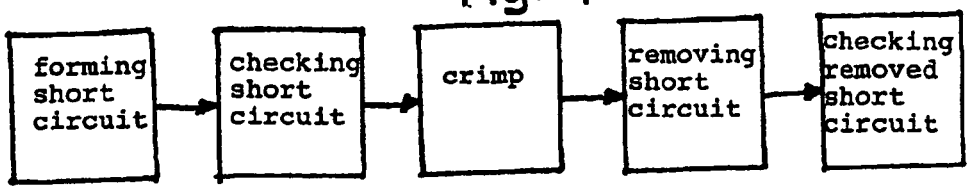

METHOD OF PRODUCING A DEACTIVATABLE RESONANCE TAG FOR USE IN AN ELECTRONIC ARTICLE SURVEILLANCE SYSTEM AND A RESONANCE TAG SO PRODUCED

The present invention relates to a method of producing a deactivatable RF resonance circuit (tag) for use in an electronic article surveillance system (EAS system).

Such resonant tags for use in EAS systems, also called resonant labels, are well known in the art. Usually such tags comprise a supporting layer formed of a dielectric material with conductive layers on its front and rear faces. One of the conductive layers on one face of the dielectric support is shaped to form an inductive component and the first part of the capacitive component whilst the other conductive layer on the other face of the dielectric support is shaped to form the second part of the capacitive component of the resonant tag.

The resonant circuit of the tag is supposed to have a high quality factor (Q-factor or Q-value).

In use a transmitter in the EAS system is emitting signals having frequencies, which are systematically varied within a specific range. When the resonant frequency of the resonant circuit of the tag is within this range, a receiver will be able to detect the presence of the tag (of the resonant circuit) when the natural frequency of the resonant circuit is emitted.

When articles provided with resonant tags are passing by the cashes at the exit of the premises where the accounts are to be settled, the removal or destruction of the tags has to take place. If this would not be done the receiver of the EAS system is detecting the attempt to pass the control area and is activating an alarm.

In order to modify the resonant circuit for its deactivation it is known to provide regions with a reduced distance between the capacitive components (capacitor plates), so that the field strength applied for deactivation will provoke a breakdown at such regions.

One solution has been proposed in U.S. Pat. Nos. 4,498,076 and 4,567,473 disclosing a method of producing a resonant tag with a circuit suitable for modification. It is proposed to create a reduced (small) distance between opposite capacitor plates of the resonant circuit, i.e. at predetermined points, by locally pressing one conductive layer down into the dielectric material of the support (impressing a notch). The remaining thickness of the dielectric material at these places becomes smaller than outside of these regions. As according to general knowledge of physics a breakdown will always occur at the place with the smallest distance, the breakdown in the capacitor will always occur through the remaining thickness of the dielectric material at this region of reduced thickness and allows furthermore to use a lower breakdown voltage than outside such a region.

This solution presents however a number of disadvantages or at least difficulties, as local compression of the dielectric material to a required minimal remaining thickness of the material (necessary to avoid the risk of an unintentional short), e.g. in the order of μm in a limited region, requires a very precise angle of 90° between a pin performing the compression and the plane of the capacitor plate and a precisely controlled pressure to obtain usable reproducible results.

The major disadvantage of the aforesaid solution is that breakdown has always to happen through the remaining thickness of dielectric material between the capacitor plates in said compressed area. When the electric arc that causes breakdown passes through the dielectric material it risks often to burn off and forms a short circuit of charred plastic material with the result that the short circuit between the two capacitor plates consist of a mix of charred plastic and metal, resulting in a mechanically very unstable short circuit. This known solution leads to a product that easily becomes reactivated, which of course is not acceptable.

Another disadvantage, resulting from the fact that the electric arc must pass through the dielectric material left after compression is that a higher breakdown voltage is needed than if breakdown could occur through a material-free space (e.g. air).

In an attempt to avoid the aforesaid disadvantage U.S. Pat. No. 4,876,555 proposes a similar method for producing a deactivatable resonant tag comprising the idea to produce a throughhole through the dielectric material between the opposite conductive layers (e.g. the capacitor plates), thus avoiding remaining dielectric material which requires higher breakdown voltages.

This proposal providing a material free throughhole passing through the dielectric material (support) leaves the conductive layers at their normal level (in order to avoid unintentional shorts). This solution also has a number of disadvantes: The throughholes in the dielectric material, containing only air, are difficult to produce, with the result that in practice no deactivatable resonant tags have been produced in accordance with this method. As an electric arc has to overcome a distance corresponding at least to the thickness of the dielectric material layer a relatively high voltage is needed for producing the breakdown for deactivating the circuit (a distance corresponding to that between the capacitor plates). This results in that there is no practical advantage compared with the state of the art described.

Finally EP patents No. 0 509 289 and No. 0 750 285 are disclosing methods of producing shorts between the conductive layers (e.g. between the opposite capacitor plates) by using heated pins and an electric current for locally melting away the dielectric material between said conductive layers and electrically welding together such layers, followed by electrically interrupting such a connection to form two opposite electrodes at varying distance between which a further conductive bridge (in form of a filament) is formed (using appropriate voltage), followed by a further interruption of the thus connected electrodes to establish a new gap of predetermined width between the electrodes ready for deactivation.

Although this process is satisfactory, it is rather complicated and leads to electrode gaps, which may at least slightly differ from product to product (difficult to check the quality).

It is therefore an object of the present invention to find a novel and simple method of producing deactivatable tags of highest quality having a resonance circuit with a high Q-factor and having as small as possible a material free distance (deactivation area) between two opposite capacitor plates. The method has to be reproducible and must result in even products of highest quality with a minimum of material to be rejected.

The aforementioned object of the invention is achieved in a surprisingly simple manner by performing the inventive steps recited in claim 1.

Preferred embodiments of the invention are defined in the depending claims.

The invention will be better understood and objects other than those set forth above will become apparent when consideration is given to the following detailed description thereof. The description makes reference to the annexed drawings, wherein:

FIG. 1 is a schematic flow diagram of the process according to the invention, and FIG. 2–7 show schematically the different successive steps carried out in producing a deactivatable resonant tag according to the invention.

Figure 3:
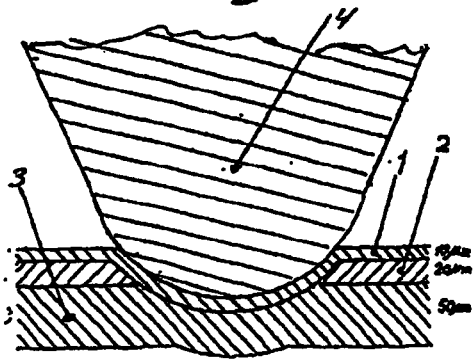
Figure 4:
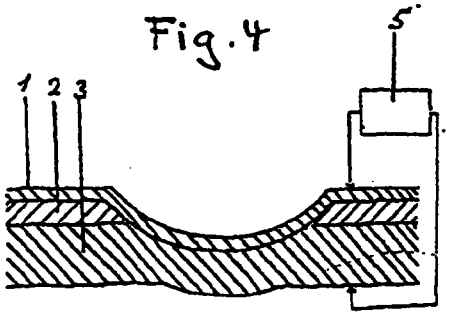
Figure 5:
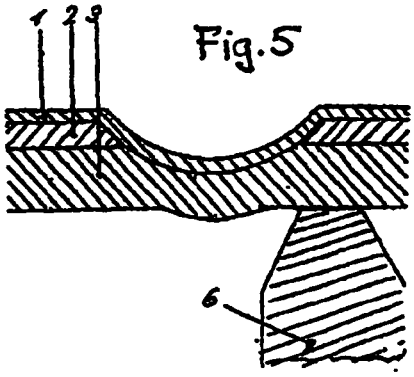

As shown by the drawings the opposite conductive layers with a supporting layer of dielectric material are first short circuited by using a heated tool of small diameter, thereby displacing the dielectric material in the zone of the short-circuit and permanently deforming one of said conductive layers. Such deformation is possible due to the plasticity of the metal (e.g. aluminium) forming the conductive layers. When forming the short, the other conductive layer is also slightly deformed (depressed) as shown by FIG. 3–5. The conductive layers, preferably the opposite capacitor plates are thus short circuited by a slight pressure on one of the plates with said heated tool until a light short between the two plates is obtained. Due to the heated tool, the dielectric material between the opposite conductive is molten away in the zone of the short circuit. A short circuit is thus obtained between the plates without any dielectric material remaining between them.

Therefore, the short circuit is precisely controlled by means of the shape of the tool, the temperature, the period of time the tool is in contact with the capacitor plate, and the weight of the tool or the pressure from the tool; all parameters are controlled electronically and mechanically.

A weight of 200 g and a tool temperature of 400° C. combined with a period of time of 1.2 sec. has proved in tests to give a stable and even short circuit.

After the short circuit has been established between the two metal surfaces (capacitor plates), the short circuit is checked by means of electronic measuring. This measuring checks whether a satisfactory short circuit has been obtained. In case the short circuit is not satisfactory, the product will be rejected as being defect When the measuring shows the short circuit is found good, the two metal layers will be crimped in a special crimp area to form a complete resonant circuit, thus giving the tag the required frequency (the crimp will connect one of the conductive layers with the opposite conductive layer in a known manner).

Figure 6:
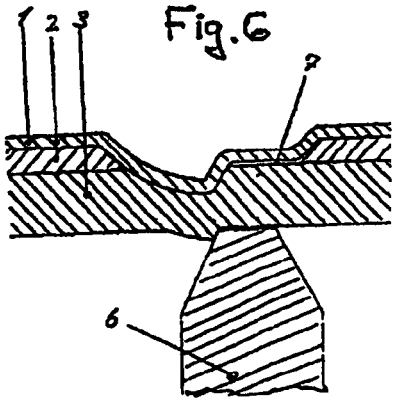
Figure 7:
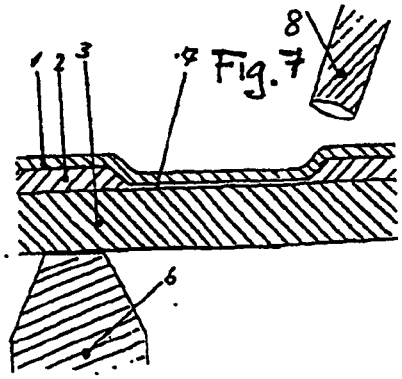

Thereafter the short circuit is removed electrically or mechanically as e.g. schematically shown in FIG. 5–7. It is electronically checked whether the short circuit has been removed. Products with unremovable or unremoved short circuits are rejected as defect products.

The developed process described herein above ensures that:

- there is no dielectric material between the capacitor plates in the deactivation zone;
- the two capacitor plates are brought closely together, e.g. to approximately 1 μm;
- the resonance circuit has a high Q-factor;
- the process is reproducible;
- the process gives an even product;
- the reactivation risk has been tested and found good;
- the oxidation layer on the two metal surfaces is discharged by the short circuit method, particularly when the short circuit is removed during the described process, so that the prepared deactivating area remains oxide free, resulting in a better deactivation than with any previously known methods.

Figure 2:
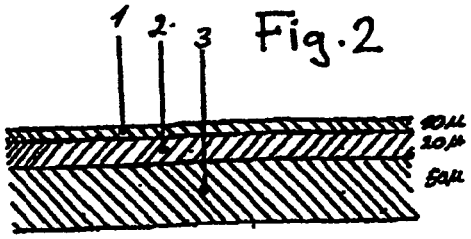

FIG. 2 shows a sectional fragment of a tag to be prepared for easy deactivation, with a first conductive layer 1 (e.g. 10 μm aluminium), a supporting layer 2 of dielectric material (e.g. 20 μm polypropylene) and a second conductive layer 3 (e.g. 50 μm aluminium).

FIG. 3 shows how a short circuit is created between the conductive layers 1 and 3 by means of a heated tool 41 permanently deforming the layers 1 and depressing layer 3, causing the dielectric material 2 to melt away.

FIG. 4 shows how the short circuit between the two conductive layers 1 and 3 (capacitor plates) are checked using measuring equipment 5.

After the check and the crimp between the two conductive layers, the short circuit as shown in FIG. 5–7 is electrically or mechanically removed by suitable equipment 6.

FIG. 6 shows a partially removed (interrupted) short circuit and FIG. 7 a completely removed short circuit, resulting in a small material Tree gap 7 between the capacitor plates 1 and 3. After checking (by suitable equipment 8) whether the short circuit has been removed, the tag is ready for use (and later deactivation).

The invention claimed is:

1. A method of producing a deactivatable resonant tag comprising a planar supporting layer made of dielectric material having opposed faces bearing first and second shaped conductive layers respectively, the first conductive layer on one face forming an inductive component and the first part of a capacitive component and the second conductive layer on the other face forming the second part of the capacitive component of a resonant circuit, the method comprising:

forming onto the two faces said planar supporting layer said first and second conductive layers;

short circuiting the two capacitive components by applying a pressure on one of said capacitive components in the direction of the other of said capacitive components thereby permanently displacing said one capacitive component towards the other by using a heated tool thereby melting and displacing the dielectric material in the region of exerting said pressure between the capacitive components until a short circuit by direct contact between the two conducive components is obtained;

checking electronically whether the short circuit thus obtained is satisfactory;

crimping the two conductive layers of products having a satisfactory short together to form a resonant circuit at the desired frequency and rejecting all not crimped products;

thereafter removing the short circuit between said two conductive components thereby forming a predetermined place for deactivation of the tag;

checking whether the formerly built up short circuit has been removed.

2. Method according to claim 1, wherein the short is mechanically removed.

3. Method according to claim 1, wherein the short is electrically removed.

4. Method according to claim 1, wherein the pressure exerted by the heated tool is applied for a time period of 1 to 2 seconds.

5. Method according to claim 1 or 4, wherein the tool is heated to a temperature of 350° C.–500° C.

6. Method according to claim 1, 2, 3 or 4, wherein a tool having a weight of 150 to 300 g is used.

7. A deactivatable resonant tag produced according to claim 1, 2, 3 or 4, comprising at least one deactivation zone between opposite surfaces of a removed short circuit between said opposite conductive layers.

8. A deactivatable resonant tag according to claim 7, wherein said removed short circuit forming a deactivation zone is in a region where one of the opposite conductive layers is locally permanently deformed in a direction towards the other conductive layer.

* * * * *